US006885158B2

(12) United States Patent
Onozawa et al.

(10) Patent No.: US 6,885,158 B2
(45) Date of Patent: Apr. 26, 2005

(54) PLASMA DISPLAY APPARATUS WITH REDUCED VOLTAGE VARIATION

(75) Inventors: Makoto Onozawa, Kawasaki (JP); Haruo Koizumi, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 10/695,132

(22) Filed: Oct. 29, 2003

(65) Prior Publication Data

US 2004/0104867 A1 Jun. 3, 2004

(30) Foreign Application Priority Data

Dec. 3, 2002 (JP) ..... 2002-351170

(51) Int. Cl.[7] ..... G09G 3/10

(52) U.S. Cl. ..... 315/169.4; 315/169.1; 315/169.2; 345/60; 345/66; 345/68; 345/204

(58) Field of Search ..... 315/169.1, 169.2, 315/169.4; 345/60, 66–68, 204, 205, 213, 214

(56) References Cited

U.S. PATENT DOCUMENTS 6,157,354 A * 12/2000 Amemiya ..... 345/60
6,281,635 B1 * 8/2001 Lee ..... 315/169.4
6,320,326 B1 * 11/2001 Shino et al. ..... 315/169.4
6,373,452 B1 4/2002 Ishii et al. ..... 345/67
6,411,268 B1 * 6/2002 Nakamura et al. ..... 345/60
6,456,263 B1 * 9/2002 Hashimoto et al. ..... 345/60
6,507,327 B1 * 1/2003 Atherton et al. ..... 345/68
6,538,389 B1 * 3/2003 Onozawa et al. ..... 315/169.1
6,570,339 B1 * 5/2003 Moore ..... 315/169.3
6,603,446 B1 * 8/2003 Kanazawa et al. ..... 345/60
2001/0005254 A1 6/2001 Oishi ..... 349/149

FOREIGN PATENT DOCUMENTS

EP 1 221 685 A2 7/2002

* cited by examiner

*Primary Examiner*—Haissa Philogene
(74) *Attorney, Agent, or Firm*—Staas & Halsey LLP

(57) ABSTRACT

A plasma display apparatus includes a plurality of electrodes for electric discharge, and a drive circuit which drives the plurality of electrodes. The drive circuit includes first and second outputting circuits provided on a board, a connector provided on the board and coupled to the plurality of electrodes, and a conductive plate which is provided on the board, and provides electrical couplings between the first and second outputting circuits and the connector. The conductive plate includes a first area connected to the first outputting circuit and a second area connected to the second outputting circuit, the first area and the second area being substantially line-symmetric.

17 Claims, 11 Drawing Sheets

( ) REPRESENTS ACTUAL
MEASUREMENT OF 32-INCH PDP

PLASMA DISPLAY APPARATUS WITH REDUCED VOLTAGE VARIATION

CROSS-REFERENCE TO RELATED APPLICATIONS

The present application is based upon and claims the benefit of priority from the prior Japanese Patent Application No. 2002-351170 filed on Dec. 3, 2002, with the Japanese Patent Office, the entire contents of which are incorporated herein by reference.

BACKGROUND OF THE INVENTION

1. Field of the Invention

The present invention generally relates to plasma display apparatuses, and particularly relates to a plasma display apparatus that displays images by generating discharge between electrodes.

2. Description of the Related Art

Plasma display panels have two glass plates on which electrodes are formed, and discharge-purpose gas fills the gap between the two glass plates that is in the order of 100 microns. Voltages higher than a discharge threshold voltage are applied between the electrodes to start gas discharge, and ultraviolet light generated from the discharge induces the light emission of photo florescent provided on the plate, thereby effecting screen displaying.

FIG. 1 is a diagram showing a schematic construction of a plasma display apparatus.

A display panel 10 includes X electrodes 11 and Y electrodes 12 disposed in parallel, and further includes address electrodes 13 disposed in perpendicular thereto. The X electrodes 11 and the Y electrodes 12 are used to provide sustain discharge for display-purpose light emission. Voltage pulses are applied between the X electrodes 11 and the Y electrodes 12, thereby carrying out sustain discharge. Further, the Y electrodes 12 serve as scan-purpose electrodes for writing display data. The address electrodes 13 are used to select display cells 15 that are to emit light. A voltage for writing discharge is applied between the Y electrodes 12 and the address electrodes 13 so as to select discharge cells. Shields 14 are provided between the address electrodes 13 for the purpose of separating the discharge cells 15.

Discharge in the plasma display panel can only assume either one of the "on" state and the "off" state, so that the density, i.e., the gray scale, is represented by the number of repeated light emissions. To this end, a frame is divided into 10 sub-fields, for example. Each sub-field is comprised of a reset period, an addressing period, and a sustain discharge period. During the reset period, all cells are equally initialized regardless of lighting status in the previous sub-fields, e.g., are placed in the condition in which wall charge is erased. During the addressing period, selective discharge (addressing discharge) is performed to select the on/off state of cells in accordance with display data, thereby selectively generating wall charge that places cells in the "on" state. During the sustain discharge period, discharge is repeated in the cells where addressing discharge was performed to generate wall discharge, thereby emitting light. The length of the sustain discharge period, i.e., the number of repeated light emissions, differs from sub-field to sub-field. For example, the ratio of the numbers of light emissions from the first sub-field to the tenth sub-field are set to 1:2:4:8: . . . : 512, respectively. Sub-fields are then selected in accordance with the luminance level of a display cell to be subjected to gas discharge, thereby achieving a desired gray scale level.

FIG. 2 is a drawing for explaining another construction of a display panel unit different from that of FIG. 1.

In a display panel unit 10A of FIG. 2, X electrodes 11A and Y electrodes 12A serving as display electrodes are provided in turn at equal intervals so as to cross address electrodes 13A. All gaps between the electrodes are utilized as display lines (L1, L2, . . . ). This configuration is called an ALIS (alternate lightning of surfaces) method (Patent Document 1). Since all the gaps between the electrodes are utilized as display lines, the number of electrodes is half as many as that of FIG. 1, which provides a basis for cost reduction and scale reduction.

Since all the gaps between electrodes serve as display lines in the ALIS method, it is impossible to light up all the display lines simultaneously. Lighting of odd-number lines (L1, L3, . . . ) and lighting of even-number lines (L2, L4, . . . ) are temporally separated to effect displaying. In the ALIS method, One frame is divided into two fields, each of which is comprised of a plurality of sub-fields. The first field is used for the displaying of odd-number lines, and the second field is used for the displaying of even-number lines.

FIG. 3 is a drawing showing the construction of a plasma display apparatus.

The plasma display apparatus of FIG. 3 includes a plasma display panel 20, a Y electrode drive circuit 21, an X electrode drive circuit 22, an address electrode drive circuit 23, a discrimination decision circuit 24, a memory 25, a control circuit 26, and a scanning circuit 27.

A vertical synchronizing signal Vsync, a horizontal synchronizing signal Hsync, a clock signal Clock, and RGB signals each comprised of 8 bits and serving as data signals are supplied to the discrimination decision circuit 24. The discrimination decision circuit 24 writes RGB data in the memory 25 as display data in response to the vertical synchronizing signal Vsync. The control circuit 26 controls the Y electrode drive circuit 21, the X electrode drive circuit 22, the address electrode drive circuit 23, and the scanning circuit 27, and displays the display data stored in the memory 25 on the plasma display panel 20. In conjunction with this, the scanning circuit 27 scans the Y electrodes Y1 through Yn, and the address electrode drive circuit 23 drives the address electrodes A1 through An, thereby together effecting writing electric discharge for writing data in the plasma display panel 20. In the display cells where data were written, further, sustain electric discharge is generated between the Y electrodes Y1 through Yn and the X electrodes X1 through Xn by the Y electrode drive circuit 21 and the X electrode drive circuit 22.

In the related-art construction shown in FIG. 3, lines y1 through yn that extend from the Y electrode drive circuit 21 to the scanning circuit 27 to be connected to the Y electrodes Y1 through Yn take different wiring paths between the Y electrode drive circuit 21 and the scanning circuit 27, so that they have different wire lengths. Likewise, the X electrodes X1 through Xn extending from the X electrode drive circuit 22 to the plasma display panel 20 take different wiring paths to have different wire lengths. In the example of FIG. 3, for example, the line y1 and the Y electrode Y1 connected thereto both having long wiring lengths have wiring resistance and wiring inductance larger than those of the line y3 and the Y electrode Y3 connected thereto both having relatively short wiring lengths. By the same token, the X electrode X1 having a long wiring length has wiring resistance and wiring inductance larger than those of the X electrode X3 having a relatively short wiring length. An effect of the wiring inductance is especially strong. Because of this, when an electric current runs through wiring lines and electrodes to generate electric discharge between the Y electrodes Y1 through Yn and the X electrodes X1 through Xn, a voltage drop occurs along the wiring lines and electrodes. The voltage drop generated in this manner differs from wiring line to wiring line and from electrode to electrode As a result of this voltage drop, when a sufficient margin cannot be secured for the discharge voltage of the plasma display panel with respect to the electrodes having a large voltage drop, a sufficient voltage required to light up an electric discharge may not be supplied. In such a case, a flicker of a screen or the like will appear, thereby degrading display quality.

In order to address a drop in the operation margin, a conductive plate layer is disposed such as to overlay the wiring lines, providing a voltage fluctuation balancing unit, which reduces the variation of voltage drops by eddy currents that occur in the conductive plate layer in response to electric currents running through the wiring lines (Patent Document 2). This method can suppress the variation of voltage drops that occur according to the length of individual wiring lines, and can increase the operation margin.

Patent Document 1

Japanese Patent No. 2801893

Patent Document 2

Japanese Patent Application Publication No. 2002-196719

FIG. 4 is an illustrative drawing showing a related-art X electrode drive circuit (or Y electrode drive circuit) as implemented on a printed circuit board.

The construction of FIG. 4 includes a printed circuit board 30, a sustain outputting pattern 31, sustain power supply capacitors 32A and 32B, sustain circuits 33A and 33B, electric power collecting capacitors 34A and 34B, electric power collecting coils 35A and 35B, ground screws 36A and 36B, and connectors 37A and 37B. The sustain circuit 33A is provided with the sustain power supply capacitor 32A, the electric power collecting capacitor 34A, a sustain power supply terminal 41A for connection with the electric power collecting coil 35A, a sustain outputting terminal 42A for connection with the sustain outputting pattern 31, and a sustain grand terminal 43A for connection with the ground screw 36A. Likewise, the sustain circuit 33B is provided with the sustain power supply capacitor 32B, the electric power collecting capacitor 34B, a sustain power supply terminal 41B for connection with the electric power collecting coil 35B, a sustain outputting terminal 42B for connection with the sustain outputting pattern 31, and a sustain grand terminal 43B for connection with the ground screw 36B.

The sustain outputting pattern 31 is a single metal plate, and serves as a conductor that supplies discharge currents (i.e., currents that run through X electrodes and Y electrodes during the sustain discharge period) from the sustain circuits 33A and 33B to the connectors 37A and 37B.

In the X electrode drive circuit (or the Y electrode drive circuit) shown in FIG. 4, the sustain circuits 33A and 33B are provided in parallel, and are together connected to the sustain outputting pattern 31 in order to secure a sufficient sustain discharge current that is supplied to the X electrodes X1 through Xn of FIG. 3 (or the Y electrodes Y1 through Yn of FIG. 3). These two sustain circuits 33A and 33B have such construction that circuit components are shifted in parallel from the upper side to the lower side across the center line of the printed circuit board shown by a dashed line.

Such arrangement of circuit components provides for design to be simplified by using the substantially same component arrangement and wiring patterns on the upper side and the lower side for the two sustain circuits 33A and 33B which are connected in parallel. Further, when a hybrid IC or a power module is used for the sustain circuits 33A and 33B, the two sustain circuits can be consolidated, resulting in the reduction of the number of circuit components.

When the construction of the printed circuit board shown in FIG. 4 is used, however, current paths extending from the sustain outputting terminals 42A and 42B to the connectors 37A and 37B differ for each terminal in the connector. Because of this, wiring resistance and wiring inductance differ for each terminal, resulting in voltage variation at the terminals being different depending on the position of terminals when sustain discharge currents flow. Consequently, a problem arises in that the operation margin of a sustain voltage drops in the plasma display apparatus.

The use of the voltage fluctuation balancing unit shown in the above-described Patent Document 2 may provide a proper measure against the drop of the operation margin. However, there is no related-art technology that teaches a specific construction of a printed circuit board.

Accordingly, there is a need for a plasma display apparatus that has an improved characteristic in the fluctuation of voltage drops, which are caused by differences in the length of current paths on a printed circuit board.

SUMMARY OF THE INVENTION

It is a general object of the present invention to provide a plasma display apparatus that substantially obviates one or more problems caused by the limitations and disadvantages of the related art.

Features and advantages of the present invention will be presented in the description which follows, and in part will become apparent from the description and the accompanying drawings, or may be learned by practice of the invention according to the teachings provided in the description. Objects as well as other features and advantages of the present invention will be realized and attained by a plasma display apparatus particularly pointed out in the specification in such full, clear, concise, and exact terms as to enable a person having ordinary skill in the art to practice the invention.

To achieve these and other advantages in accordance with the purpose of the invention, the invention provides a plasma display apparatus, including a plurality of electrodes for electric discharge and a drive circuit which drives the plurality of electrodes. The drive circuit includes first and second outputting circuits provided on a board, a connector provided on the board and coupled to the plurality of electrodes, and a conductive plate which is provided on the board, and provides electrical couplings between the first and second outputting circuits and the connector. The conductive plate includes a first area connected to the first outputting circuit and a second area connected to the second outputting circuit, the first area and the second area being substantially line-symmetric.

In the plasma display apparatus as described above, the conductive plate electrically connecting between the outputting circuits and the connector is provided in line-symmetric form. Because of this, variation in distance from the outputting circuits to the connector is reduced when the outputting circuits are arranged in parallel, thereby suppressing voltage variation.

According to another aspect of the invention, an eddy current layer is provided to generate an eddy current in a direction opposite to the direction of a discharge current running through the conductive plate, thereby suppressing inductance generated by the conductive plate. Proper positioning of the eddy current layer can thus reduce a voltage drop occurring due to an effect of wire inductance with respect to connector terminals that are situated relatively far away from the outputting terminal of the outputting circuit.

According to another aspect of the invention, a slit is provided in the conductive plate so as to make a discharge current bypass the slit, thereby extending the path of a discharge current, resulting in an increase in inductance generated by the conductive plate. Proper positioning of the slit thus enhances a voltage drop occurring due to an effect of wire inductance with respect to connector terminals that are situated relatively close to the outputting terminal of the outputting circuit. This makes it possible to improve the overall balance of voltage drops.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 1:
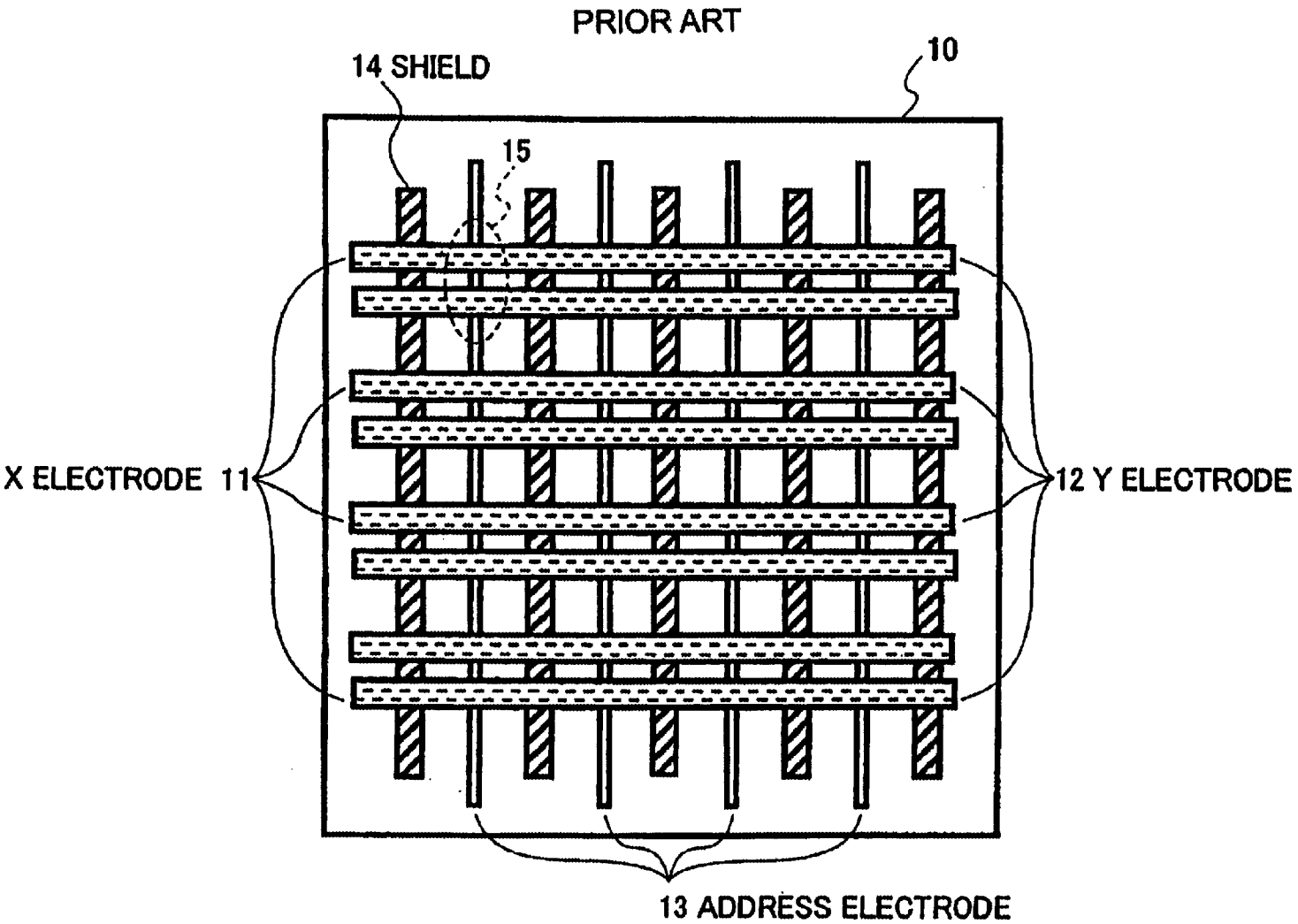
FIG.1 PRIOR ART
FIG. 1 is a diagram showing a schematic construction of a plasma display apparatus.
Figure 5:
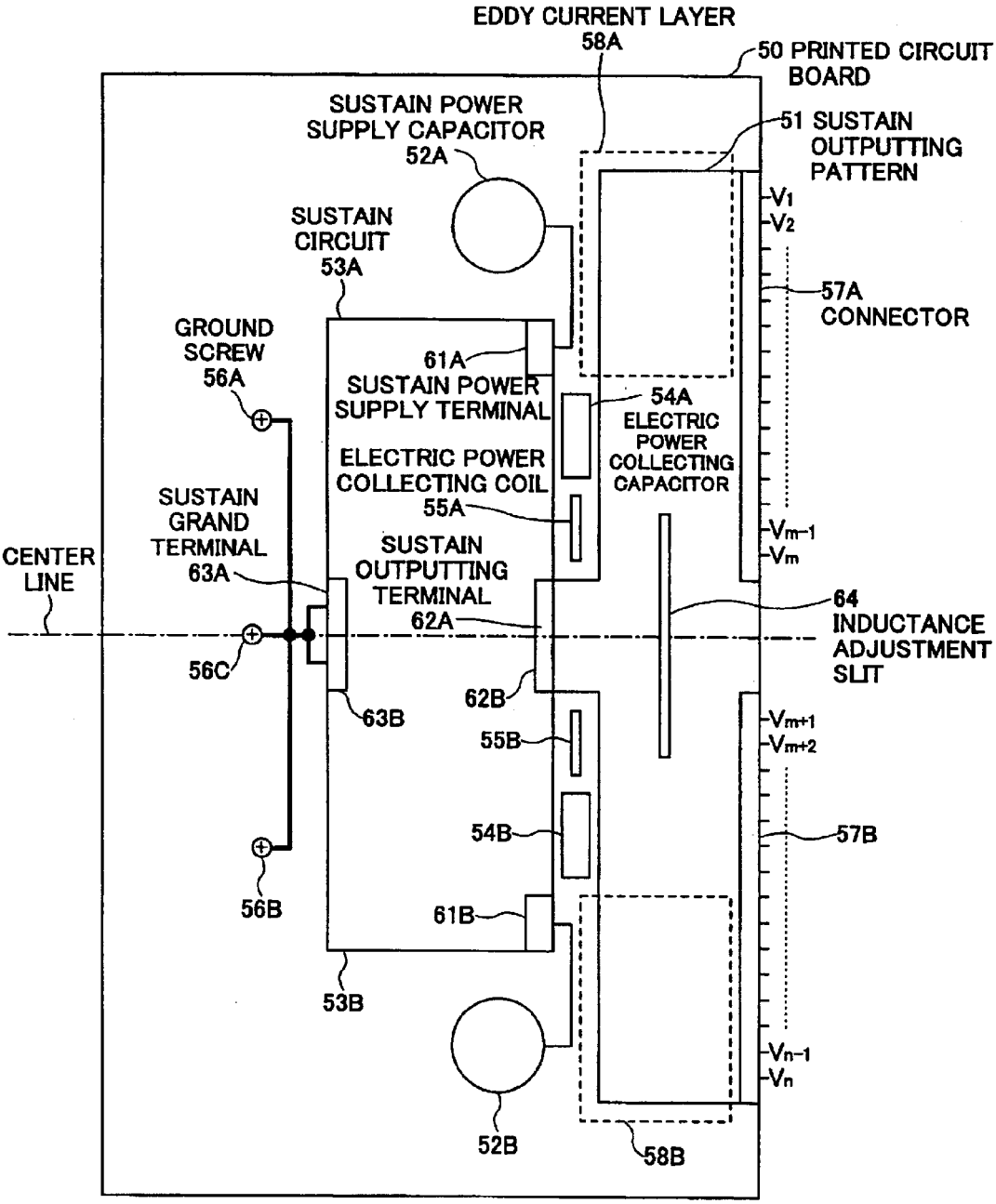
FIG. 5 is an illustrative drawing showing an example of the construction of an X electrode drive circuit (or Y electrode drive circuit) according to the invention.

FIG. 5 is an illustrative drawing showing an example of the construction of an X electrode drive circuit (or Y electrode drive circuit) according to the invention. The X electrode drive circuit (or the Y electrode drive circuit) shown in FIG. 5 drives the plasma display panel shown in FIG. 1, and supplies the same sustain pulse to all the X electrodes (or Y electrodes).

The X electrode drive circuit (or Y electrode drive circuit) of FIG. 5 includes a printed circuit board 50, a sustain outputting pattern 51, sustain power supply capacitors 52A and 52B, sustain circuits 53A and 53B, electric power collecting capacitors 54A and 54B, electric power collecting coils 55A and 55B, ground screws 56A through 56C, connectors 57A and 57B, and eddy current layers 58A and 58B. The sustain circuit 53A is provided with the sustain power supply capacitor 52A, the electric power collecting capacitor 54A, a sustain power supply terminal 61A for connection with the electric power collecting coil 55A, a sustain outputting terminal 62A for connection with the sustain outputting pattern 51, and a sustain grand terminal 63A for connection with the ground screws 56A through 56C. Likewise, the sustain circuit 53B is provided with the sustain power supply capacitor 52B, the electric power collecting capacitor 54B, a sustain power supply terminal 61B for connection with the electric power collecting coil 55B, a sustain outputting terminal 62B for connection with the sustain outputting pattern 51, and a sustain grand terminal 63B for connection with the ground screws 56A through 56C.

The sustain outputting pattern 51 is a single metal plate, and serves as a conductor that supplies discharge currents (i.e., currents that run through X electrodes and Y electrodes during the sustain discharge period) from the sustain circuits 53A and 53B to the connectors 57A and 57B.

In the X electrode drive circuit (or the Y electrode drive circuit) shown in FIG. 5, the sustain circuits 53A and 53B are provided in parallel, and are together connected to the sustain outputting pattern 51 in order to secure a sufficient sustain discharge current that is supplied to the plasma display panel.

In the construction of the invention shown in FIG. 5, the sustain outputting pattern 51 has a line-symmetric shape in respect of the center line shown by a dashed line. This provides such a design that the wiring length from the sustain outputting terminal 62A of the sustain circuit 53A to the connector 57A is line-symmetric with the wiring length from the sustain outputting terminal 62B of the sustain circuit 53B to the connector 57B.

The eddy current layer 58A is provided near the top of the sustain outputting pattern 51 as a separate layer next to the wiring layer in which the sustain outputting pattern 51 is formed on the printed circuit board. The eddy current layer 58A is placed in the floating state that is not coupled to any potential, or is coupled to a predetermined direct-current potential only at a single point. In the eddy current layer 58A, an eddy current flows in a direction opposite to the direction of a sustain discharge current running through the sustain outputting pattern 51, and functions to suppress inductance generated by the sustain outputting pattern 51.

By the function of this eddy current layer 58A, a voltage drop occurring due to the effect of wiring inductance can be reduced with respect to the terminals of the connector 57A that are positioned farther away from the sustain outputting terminal 62A.

By the same token, the eddy current layer 58B is provided near the bottom of the sustain outputting pattern 51 as a separate layer next to the wiring layer in which the sustain outputting pattern 51 is formed on the printed circuit board. By the function of this eddy current layer 58B, a voltage drop occurring due to the effect of wiring inductance can be reduced with respect to the terminals of the connector 57B that are positioned farther away from the sustain outputting terminal 62B.

Moreover, an inductance adjustment slit 64 is provided around the center of the sustain outputting pattern 51. Paths are relatively short when they are taken from the sustain outputting terminals 62A and 62B to the terminals of the connectors 57A and 57B by crossing a portion around the center of the sustain outputting pattern 51. Provision of the inductance adjustment slit 64 around the center makes the flow of a sustain discharge current bypass the inductance adjustment slit 64. As a result, the path of sustain discharge currents from the sustain outputting terminals 62A and 62B to the connectors 57A and 57B are extended, thereby increasing the inductance generated by the sustain outputting pattern 51. Namely, a voltage drop occurring due to the effect of wiring inductance increases with respect to the terminals of the connectors 57A and 57B that are located relatively close to the sustain outputting terminals 62A and 62B.

In this manner, the function of the eddy current layers 58A and 58B and the function of the inductance adjustment slit 64 provide for a voltage drop produced by the wiring inductance of the sustain outputting pattern 51 to be evenly adjusted with respect to all the terminals of the connectors 57A and 57B. That is, the variation of voltage fluctuation at the terminals can be suppressed. It should be noted, here, that the same effect can be achieved by use of only either one of the eddy current layers 58A and 58B and the inductance adjustment slit 64.

In the construction shown in FIG. 5, further, the sustain power supply terminals 61A and 61B, the sustain outputting terminals 62A and 62B, and the sustain grand terminals 63A and 63B are also arranged line-symmetric with respect to the center line. Further, circuit parts such as the sustain power supply capacitors 52A and 52B, the ground screws 56A through 56C, the electric power collecting capacitors 54A and 54B, and the electric power collecting coils 55A and 55B are arranged line-symmetric in respect of the center line. This provides a function to reduce differences in voltage variation that occur at the connectors 57A and 57B.

Specifically, an electric power collecting circuit (power save circuit) includes the electric power collecting capacitors for accumulating collected electric power and the electric power collecting coils situated between the electric power collecting capacitors and the conductive plate. The electric power collecting capacitor 54A and the electric power collecting coil 55A of the sustain circuit 53A are arranged substantially line-symmetric with the electric power collecting capacitor 54B and the electric power collecting coil 55B of the sustain circuit 53B across the center line of the line-symmetric conductive plate.

Figure 6:
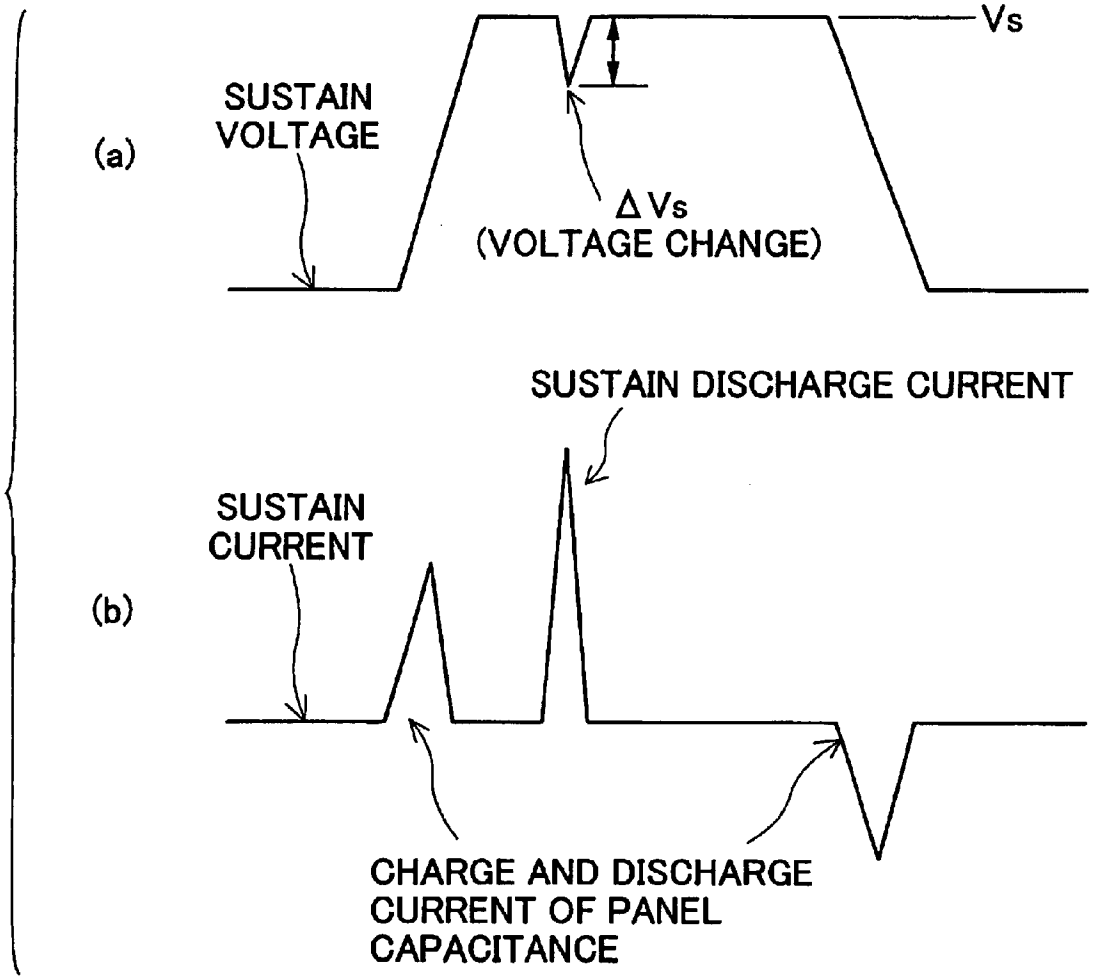
FIG. 6 is a drawing showing voltage and current waveforms regarding the operation of a sustain outputting unit.

FIG. 6 is a drawing showing voltage and current waveforms regarding the operation of the sustain outputting unit. Letter designation (a) illustrates temporal changes of the sustain voltage, and letter designation (b) illustrates temporal changes of the sustain current. In (a), Vs is a sustain voltage of the sustain discharge period, and ΔVs is a voltage change that occurs when a sustain discharge current flows at the time of discharge. At the timing at which the sustain voltage changes as shown in (a), the sustain current runs as shown in (b).

Figure 4:
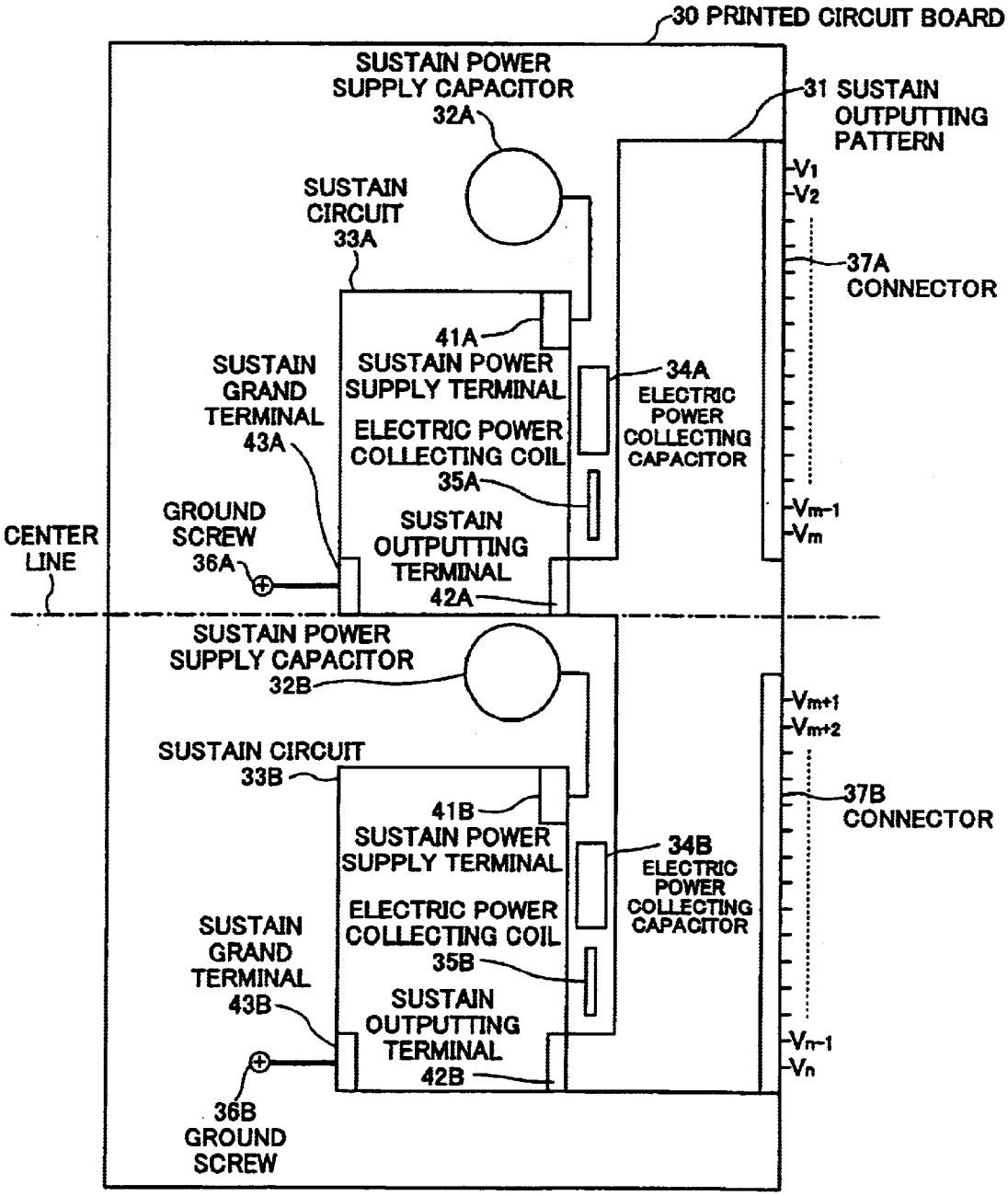
FIG.4 PRIOR ART
FIG. 4 is an illustrative drawing showing a related-art X electrode drive circuit (or Y electrode drive circuit) as implemented on a printed circuit board.
Figure 7:
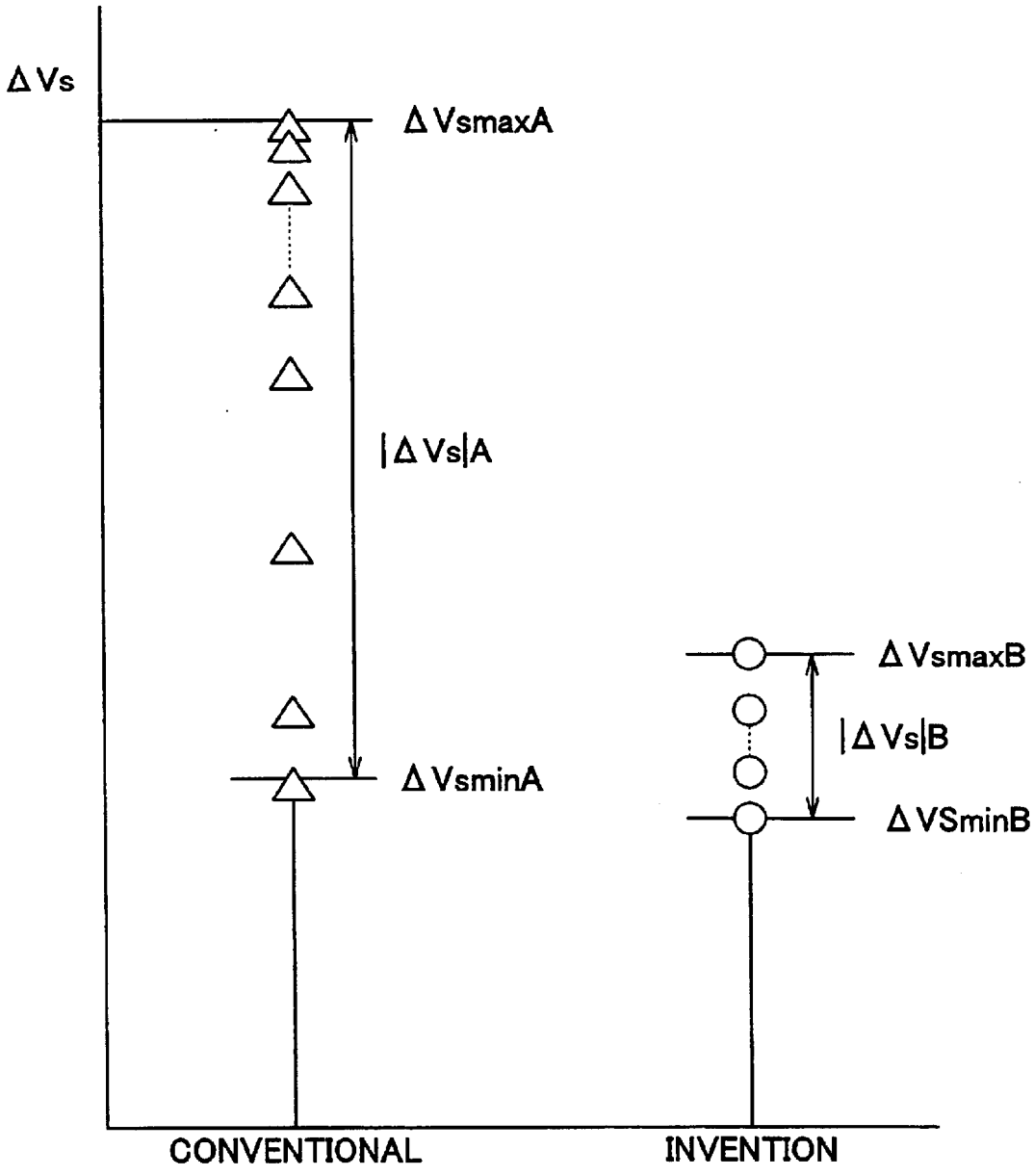
FIG. 7 is a chart showing a voltage change ΔVs occurring when the X electrode drive circuit (or Y electrode drive circuit) of the conventional art shown in FIG. 4 is used and a voltage change ΔVs occurring when the X electrode drive circuit (or Y electrode drive circuit) of the invention shown in FIG. 5 is used.

FIG. 7 is a chart showing a voltage change ΔVs occurring when the X electrode drive circuit (or Y electrode drive circuit) of the conventional art shown in FIG. 4 is used and a voltage change ΔVs occurring when the X electrode drive circuit (or Y electrode drive circuit) of the invention shown in FIG. 5 is used.

In FIG. 7, the maximum and minimum of the voltage change ΔVs in the case of the conventional art are designated as ΔVsmaxA and ΔVsminA, respectively, with a difference between the maximum and the minimum being |ΔVs|A. Further, the maximum and minimum of the voltage change ΔVs according to the invention are designated as ΔVsmaxB and ΔVsminB, respectively, with a difference between the maximum and the minimum being |ΔVs|B. With a 32-inch plasma display panel, for example, a voltage change ΔVs may be measured where the white color is uniformly displayed on the entire screen. In such a case, a difference |ΔVs|A between the maximum and minimum of the voltage change ΔVs in the case of the conventional circuit is 7.3 V, whereas a difference |ΔVs|B between the maximum and minimum of the voltage change ΔVs in the invention is reduced to 2.7V.

Figure 8:
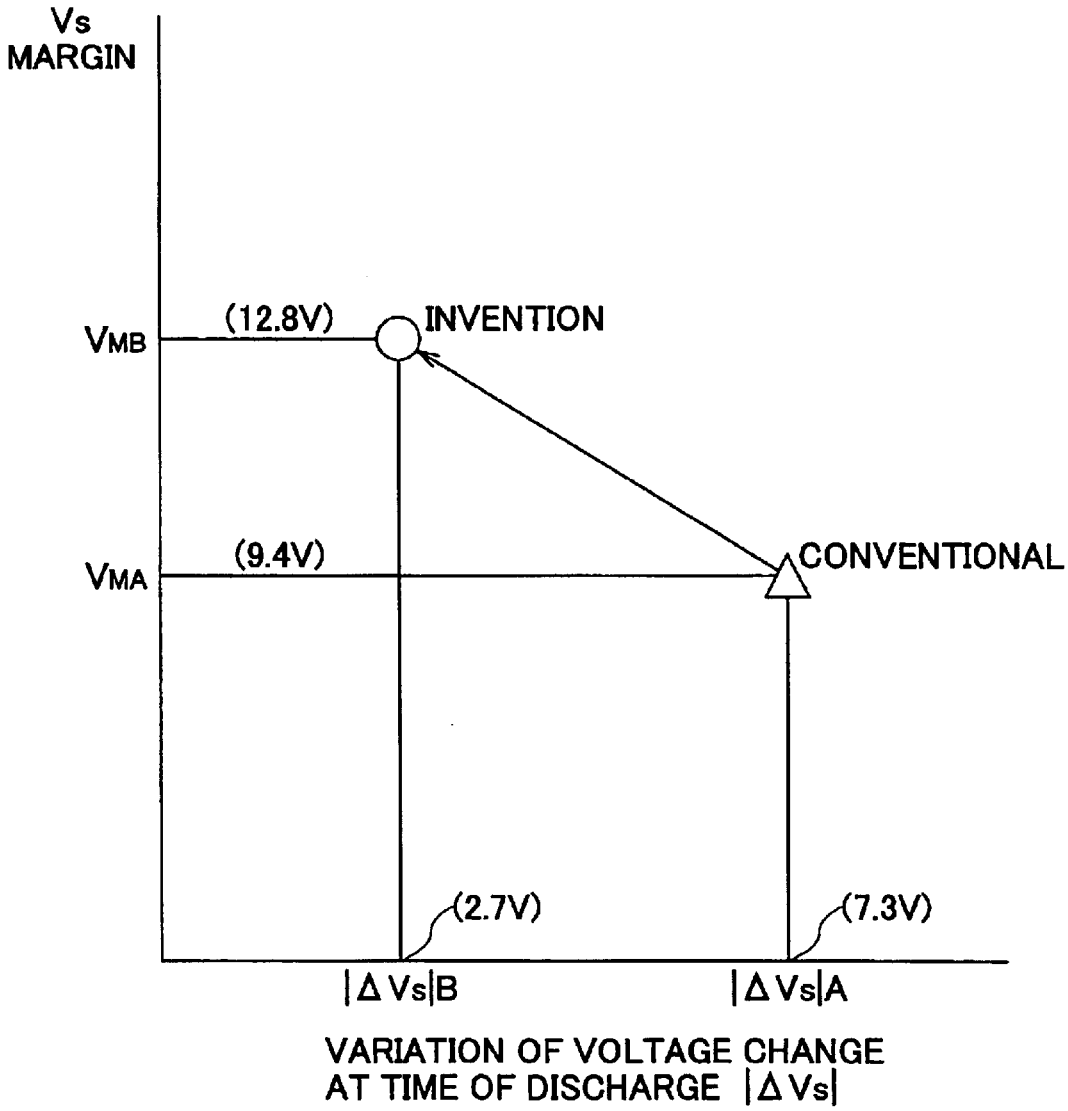
FIG. 8 is a chart showing the operation margin of a sustain voltage in a 32-inch plasma display panel which employs the construction of the invention.

FIG. 8 is a chart showing the operation margin of a sustain voltage in a 32-inch plasma display panel which employs the construction of the invention.

In FIG. 8, a vertical axis represents the operation margin (Vs margin) of a sustain voltage, and a horizontal axis represents a difference |ΔVs| between the maximum and minimum of the voltage change ΔVs at the time of sustain discharge. Here, the Vs margin is a difference between a maximum Vsmax and a minimum Vsmin of a sustain voltage that achieves proper sustain discharge for a plasma display panel. If the sustain voltage Vs falls between the maximum Vsmax and the minimum Vsmin of a sustain voltage that achieves proper sustain discharge, proper sustain discharge can be maintained. If the sustain voltage Vs is higher or lower than the limits of this range, proper sustain discharge cannot be provided, resulting in the degradation of image quality such as flickers.

Even if product variation exists in plasma display panels, setting the sustain voltage Vs around a median voltage of the proper sustain discharge range by leaving a comfortable margin makes it possible to provide a stable operation for a plasma display panel. Even if Vsmax and Vsmin unique to each product of plasma display panels vary, a wide Vs margin provides for a wide operation range that achieves proper displaying, thereby improving a yield in the manufacturing of plasma display panels.

When the construction of a conventional printed circuit board is used for a 32-inch plasma display panel, the difference |ΔVs|A between the maximum and minimum of the voltage change Vs of a sustain voltage is 7.3 V as shown in the horizontal axis of FIG. 8. When the construction of a printed circuit board according to the invention is used, the difference |ΔVs|A between the maximum and minimum of the voltage change Vs of a sustain voltage is 2.7 V. As a consequence, the actual measurement of a Vs margin becomes wider for the invention as shown in the vertical axis of FIG. 8. Specifically, a Vs margin VMB in the case of the conventional printed circuit board is 9.4 V, whereas a Vs margin VMA in the case of the printed circuit board of the invention is increased to 12.8 V (approximately a 36% increase). In this manner, the construction of the invention, as compared with the conventional construction, provides a wider range for proper display operations, thereby improving a yield in the manufacturing of plasma display panels. In general, sufficiently stable operations can be achieved if a difference between the maximum and minimum of the voltage change ΔVs at the time of sustain discharge is set to 5 V or less even if product variation exists in the manufacturing of printed circuit boards. With the provision according to the invention as described above, a difference between the maximum and minimum of the voltage change at the time of sustain discharge can be set equal to or less than 5 V.

Figure 2:
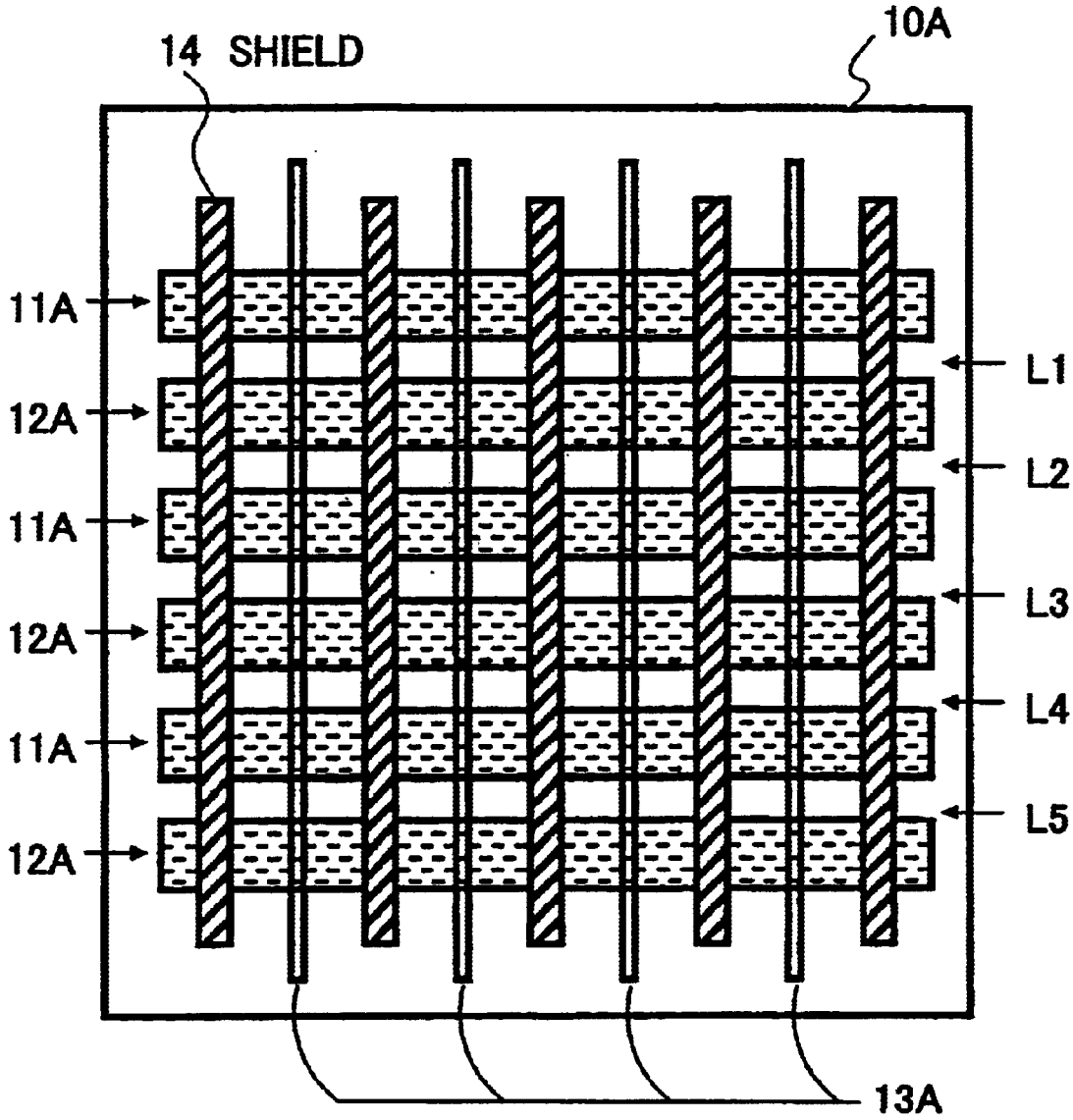
FIG.2 PRIOR ART
FIG. 2 is a drawing for explaining another construction of a display panel unit different from that of FIG. 1.

In the following, a description will be given of a case where the construction of a printed circuit board according to the invention is applied to a plasma display apparatus of the ALIS method shown in FIG. 2.

Figure 3:
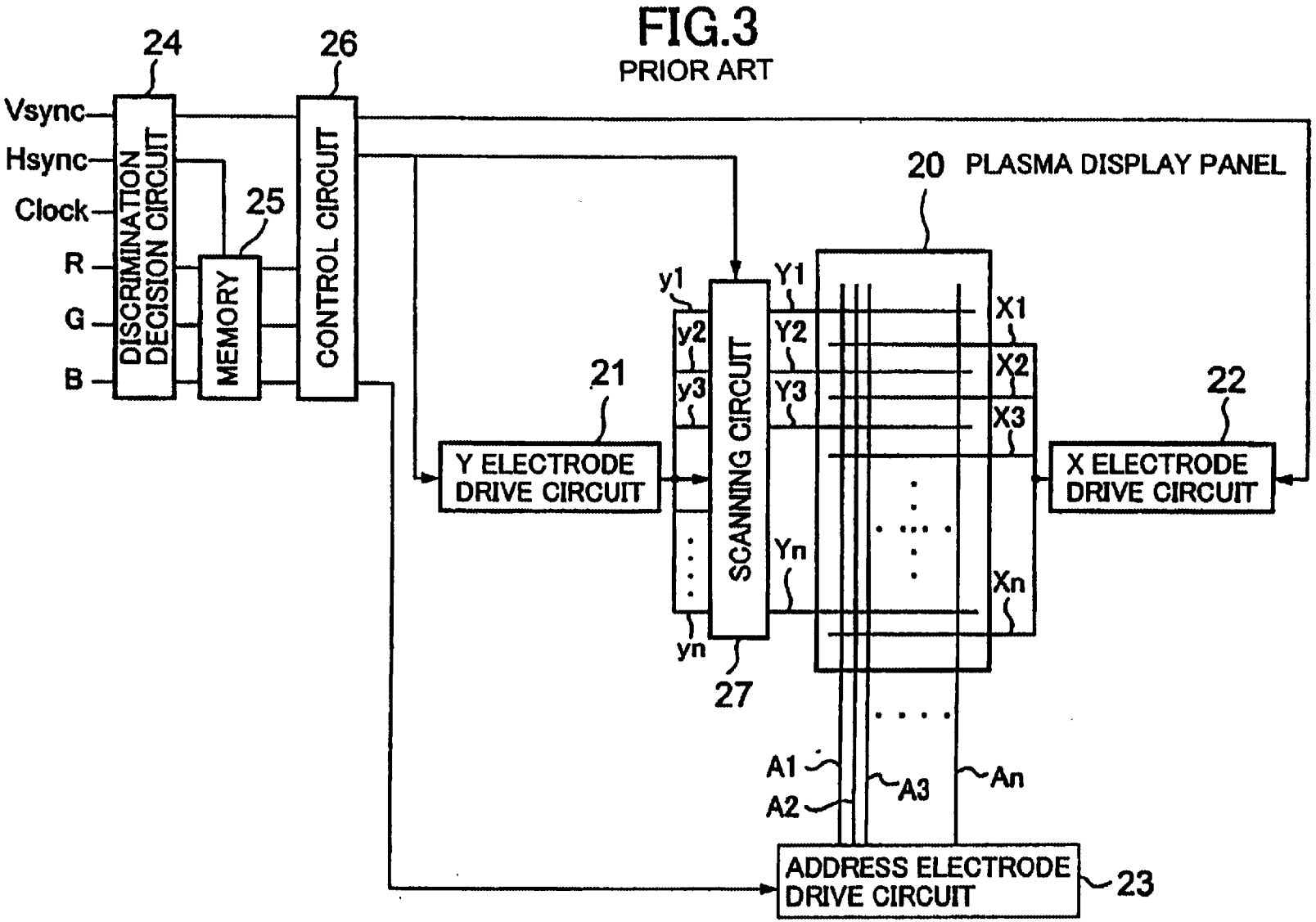
FIG.3 PRIOR ART
FIG. 3 is a drawing showing the construction of a plasma display apparatus.
Figure 9:
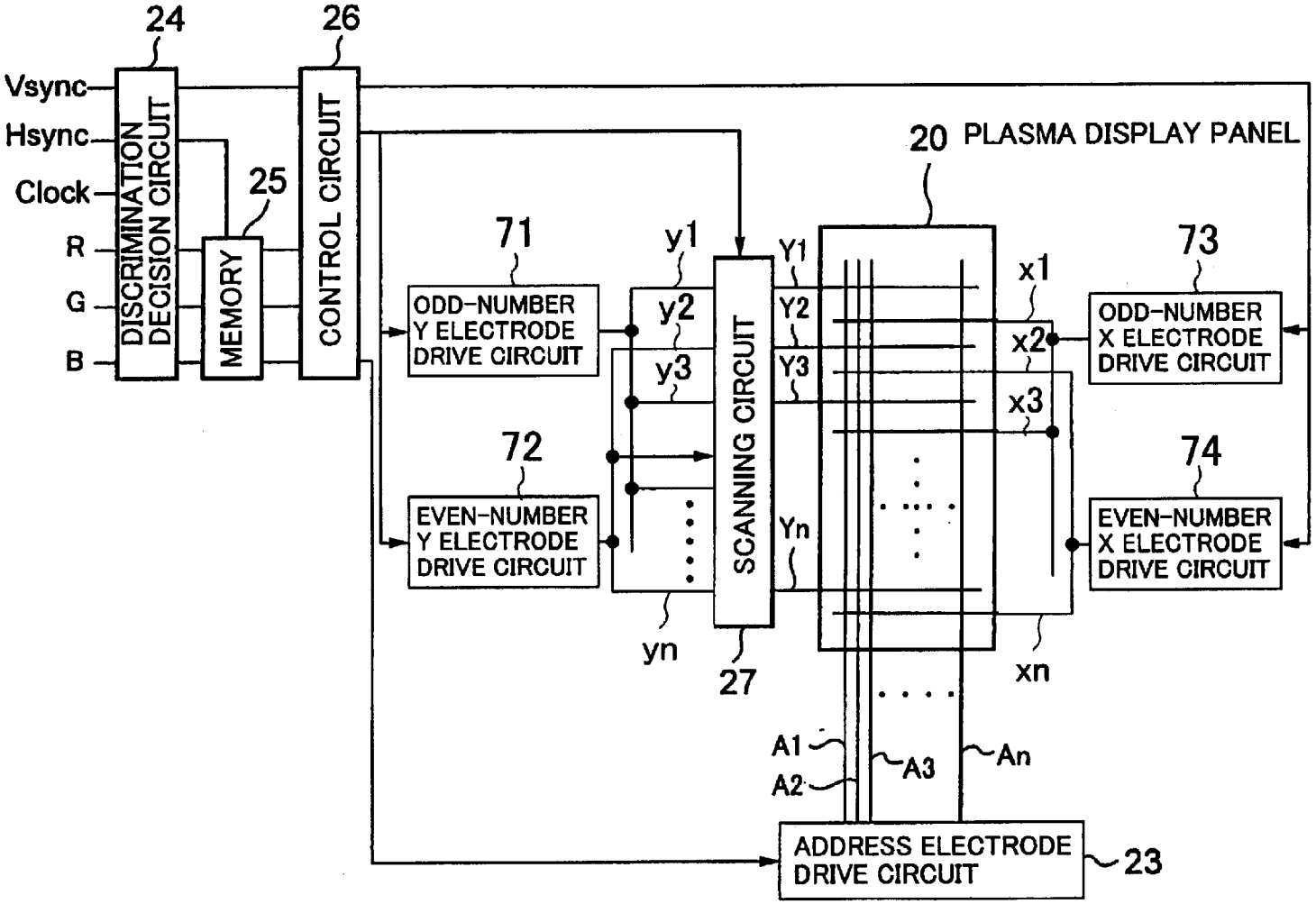
FIG. 9 is a block diagram showing an example of the construction of a plasma display apparatus that drives the plasma display panel of the ALIS method.

FIG. 9 is a block diagram showing an example of the construction of a plasma display apparatus that drives the plasma display panel of the ALIS method. In FIG. 9, the same elements as those of FIG. 3 are referred to by the same numerals, and a description thereof will be omitted.

The plasma display apparatus of FIG. 9 includes the plasma display panel 20, an odd number Y electrode drive circuit 71, an even-number Y electrode drive circuit 72, an odd-number X electrode drive circuit 73, an even-number X electrode drive circuit 74, the address electrode drive circuit 23, the discrimination decision circuit 24, the memory 25, the control circuit 26, and the scanning circuit 27. In the plasma display apparatus of FIG. 9, the respective electrode drive circuits for the Y electrodes and the X electrodes are each divided into a drive circuit for driving odd number electrodes and a drive circuit for driving even number electrodes. Such a configuration is suitable for driving the plasma display panel of the ALIS method shown in FIG. 2.

Figure 10:
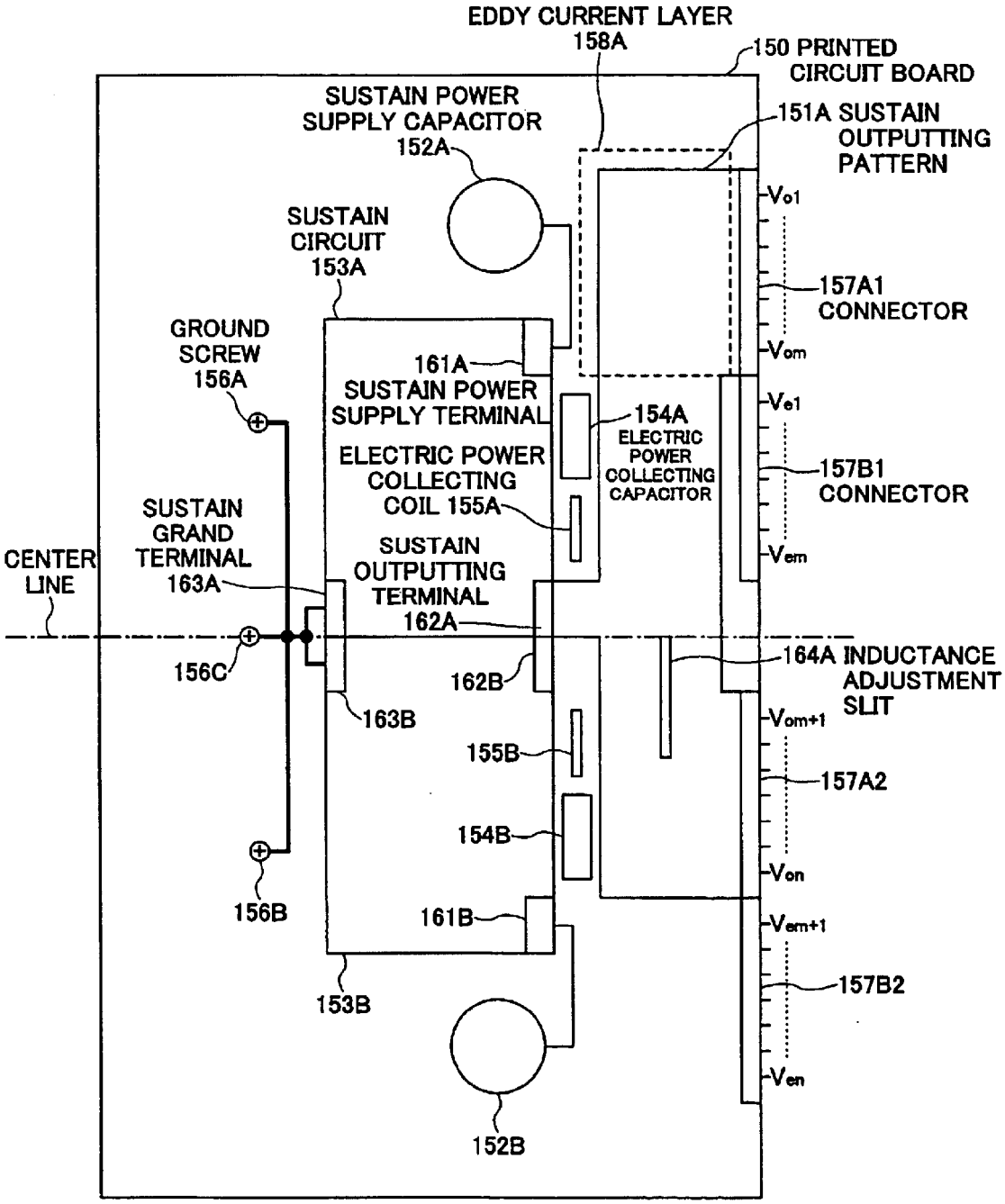
FIG. 10 is an illustrative drawing showing an example of the construction of the X electrode drive circuit (or Y electrode drive circuit) according to the invention.

FIG. 10 is an illustrative drawing showing an example of the construction of the X electrode drive circuit (or Y electrode drive circuit) according to the invention. The X electrode drive circuit (or Y electrode drive circuit) shown in FIG. 10 corresponds to the odd-number X electrode drive circuit 73 and the even-number X electrode drive circuit 74 of FIG. 9 (or the odd-number Y electrode drive circuit 71 and the even-number Y electrode drive circuit 72), and supplies a sustain pulse to all the even-number X electrodes (or Y electrodes) and a sustain pulse to all the odd-number X electrodes (or Y electrodes).

Figure 11:
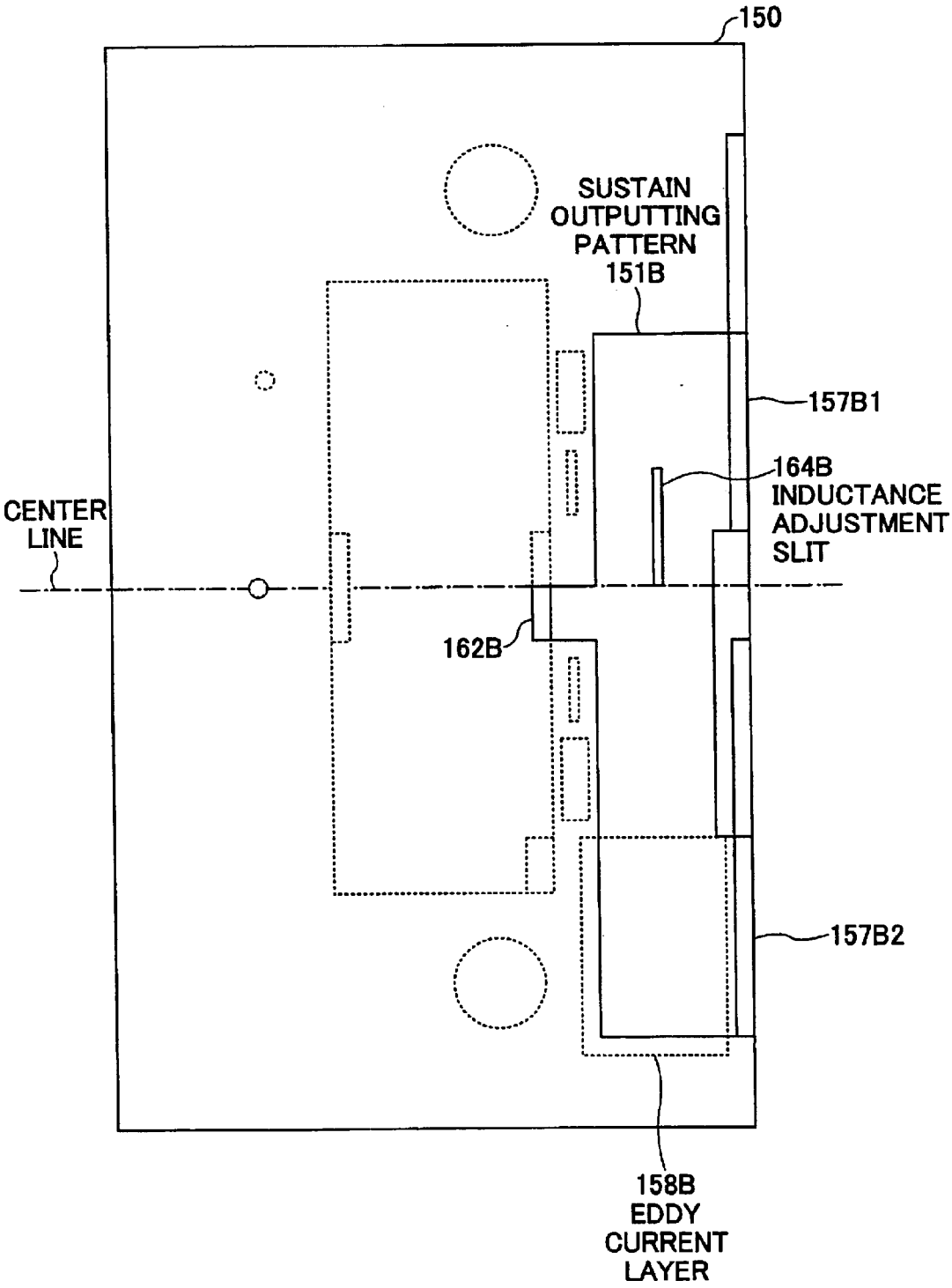
FIG. 11 is a perspective view of the printed circuit board of FIG. 10 on which the X electrode drive circuit (or Y electrode drive circuit) is mounted, as viewed from the side where circuit parts are mounted.

FIG. 10 is an illustrative drawing showing a printed circuit board on which the X electrode drive circuit (or Y electrode drive circuit) is mounted, as viewed from the side where circuit parts are mounted. FIG. 11 is a perspective view of the printed circuit board of FIG. 10 on which the X electrode drive circuit (or Y electrode drive circuit) is mounted, as viewed from the side where circuit parts are mounted.

The X electrode drive circuit (or Y electrode drive circuit) of FIG. 10 and FIG. 11 includes a printed circuit board 150, sustain outputting patterns 151A and 151B, sustain power supply capacitors 152A and 152B, sustain circuits 153A and 153B, electric power collecting capacitors 154A and 154B, electric power collecting coils 155A and 155B, ground screws 156A through 156C, connectors 157A1, 157A2, 157B1, and 157B2, and eddy current layers 158A and 158B. The sustain circuit 153A is provided with the sustain power supply capacitor 152A, the electric power collecting capacitor 154A, a sustain power supply terminal 161A for connection with the electric power collecting coil 155A, a sustain outputting terminal 162A for connection with the sustain outputting pattern 151A, and a sustain grand terminal 163A for connection with the ground screws 156A through 156C. Likewise, the sustain circuit 153B is provided with the sustain power supply capacitor 152B, the electric power collecting capacitor 154B, a sustain power supply terminal 161B for connection with the electric power collecting coil 155B, a sustain outputting terminal 162B for connection with the sustain outputting pattern 151B, and a sustain grand terminal 163B for connection with the ground screws 156A through 156C.

The sustain outputting pattern 151A is a single metal plate, and is provided on the printed circuit board 150 on a surface where circuit parts are mounted. The sustain outputting pattern 151A serves as a conductor that supplies sustain discharge currents (i.e., currents that run through the X electrodes and the Y electrodes during the sustain discharge period) from the sustain outputting terminal 162A of the sustain circuit 153A to the connectors 157A1 and 157A2. The connectors 157A1 and 157A2 have terminals Vol through Von, which are coupled to odd-number electrodes of the X electrodes (or Y electrodes). Similarly, the sustain outputting pattern 151B is a single metal plate, and is provided on the printed circuit board 150 on a surface where solders are deposited. The sustain outputting pattern 151B serves as a conductor that supplies sustain discharge currents from the sustain outputting terminal 162B of the sustain circuit 153B to the connectors 157B1 and 157B2. The connectors 157B1 and 157B2 have terminals Ve1 through Ven, which are coupled to even-number electrodes of the X electrodes (or Y electrodes).

In the construction of the invention shown in FIG. 10 and FIG. 11, the sustain outputting pattern 151A and the sustain outputting pattern 151B are designed to be line-symmetric in respect of the center line illustrated by dashed lines.

The eddy current layer 158A is provided near the top of the sustain outputting pattern 151A as a separate layer next to the wiring layer in which the sustain outputting pattern 151A is formed on the printed circuit board. The eddy current layer 158A is placed in the floating state that is not coupled to any potential, or is coupled to a predetermined direct-current potential only at a single point. In the eddy current layer 158A, an eddy current flows in a direction opposite to the direction of a sustain discharge current running through the sustain outputting pattern 151A, and functions to suppress inductance generated by the sustain outputting pattern 151A.

By the function of this eddy current layer 158A, a voltage drop occurring due to the effect of wiring inductance can be reduced with respect to the terminals of the connector 157A1 that are positioned farther away from the sustain outputting terminal 162A.

By the same token, the eddy current layer 158B is provided near the bottom of the sustain outputting pattern 151B as a separate layer next to the wiring layer in which the sustain outputting pattern 151B is formed on the printed circuit board. By the function of this eddy current layer 158B, a voltage drop occurring due to the effect of wiring inductance can be reduced with respect to the terminals of the connector 157B2 that are positioned farther away from the sustain outputting terminal 162B.

Moreover, an inductance adjustment slit 164A is provided in the sustain outputting pattern 151A around the connector 157A2. At this portion, paths are relatively short when they are taken from the sustain outputting terminal 162A to the terminals of the connector 157A2. Provision of the inductance adjustment slit 164A makes the flow of a sustain discharge current bypass the inductance adjustment slit 164A. As a result, the path of sustain discharge currents from the sustain outputting terminal 162A to the connector 157A2 are extended, thereby increasing the inductance generated by the sustain outputting pattern 151A. Namely, a voltage drop occurring due to the effect of wiring inductance increases with respect to the terminals of the connector 157A2 that are located relatively close to the sustain outputting terminal 162A. By the same token, an inductance adjustment slit 164B is provided in the sustain outputting pattern 151B around the connector 157B1.

In this manner, the function of the eddy current layer 158A and the function of the inductance adjustment slit 164A provide for a voltage drop produced by the wiring inductance of the sustain outputting pattern 151A to be evenly adjusted with respect to all the terminals of the connectors 157A1 and 157A2. Moreover, the function of the eddy current layer 158B and the function of the inductance adjustment slit 164B provide for a voltage drop produced by the wiring inductance of the sustain outputting pattern 151B to be evenly adjusted with respect to all the terminals of the connectors 157B1 and 157B2.

With this provision, the variation of voltage fluctuation at the terminals can be suppressed. It should be noted, here, that the same effect can be achieved by use of only either one of the eddy current layer and the inductance adjustment slit.

In the construction shown in FIG. 10, further, the sustain power supply terminals 161A and 161B, the sustain outputting terminals 162A and 162B, and the sustain grand terminals 163A and 163B are arranged line-symmetric with respect to the center line. Further, circuit parts such as the sustain power supply capacitors 152A and 152B, the ground screws 156A through 156C, the electric power collecting capacitors 154A and 154B, and the electric power collecting coils 155A and 155B are arranged line-symmetric in respect of the center line. This provides a function to reduce differences in voltage variation that occur at the connectors, i.e., provides a function to reduce the variation of the voltage change $\Delta Vs$ that occurs at the X electrodes or the Y electrodes at the time of sustain discharge.

Consequently, the operation margin of the plasma display apparatus is increased.

Further, the present invention is not limited to these embodiments, but various variations and modifications may be made without departing from the scope of the present invention.

What is claimed is:

1. A plasma display apparatus, comprising:

a plurality of electrodes for electric discharge; and a drive circuit which drives said plurality of electrodes, wherein said drive circuit includes:

first and second outputting circuits provided on a board;

a connector provided on the board and coupled to said plurality of electrodes; and a conductive plate which is provided on the board, and provides electrical couplings between said first and second outputting circuits and said connector, wherein said conductive plate includes a first area connected to the first outputting circuit and a second area connected to the second outputting circuit, said first area and said second area being substantially line-symmetric.

2. The plasma display apparatus as claimed in claim 1, wherein said first and second outputting circuits are arranged substantially line-symmetric with each other in respect of a center line of the line-symmetry of said conductive plate.

3. The plasma display apparatus as claimed in claim 1, wherein said connector coupled to said plurality of electrodes is arranged substantially line-symmetric in respect of a center line of the line-symmetry of said conductive plate.

4. The plasma display apparatus as claimed in claim 1, further comprising an eddy current layer that overlays said conductive plate for generating an eddy current responsive to an electric current running through said conductive plate.

5. The plasma display apparatus as claimed in claim 4, wherein said eddy current layer is situated around a perimeter of said conductive plate that is at a distance from a center line of the line-symmetry of said conductive plate.

6. The plasma display apparatus as claimed in claim 1, wherein said conductive plate includes a slit formed therethrough.

7. The plasma display apparatus as claimed in claim 6, wherein said slit is situated near a center line of the line-symmetry of said conductive plate so as to make an electric current flowing in said conductive plate bypass around said slit.

8. The plasma display apparatus as claimed in claim 1, wherein said first outputting circuit and said second outputting circuit include a first outputting terminal and a second outputting terminal, respectively, which are coupled to said first area and said second area, respectively, said first outputting terminal and said second outputting terminal being provided near a center line of the line-symmetry of said conductive plate.

9. The plasma display apparatus as claimed in claim 1, wherein said first outputting circuit and said second outputting circuit include a first ground terminal and a second ground terminal, respectively, said first ground terminal and said second ground terminal being arranged substantially line-symmetric with each other in respect of a center line of the line-symmetry of said conductive plate.

10. The plasma display apparatus as claimed in claim 9, wherein said drive circuit includes a ground screw that is provided on said board and connected to said first ground terminal and said second ground terminal, said ground screw being situated near the center line of the line-symmetry of said conductive plate.

11. The plasma display apparatus as claimed in claim 9, wherein said drive circuit includes a first ground screw and a second ground screw that are provided on said board and connected to said first ground terminal and said second ground terminal, said first ground screw and said second ground screw being arranged substantially line-symmetric with each other in respect of the center line of the line-symmetry of said conductive plate.

12. The plasma display apparatus as claimed in claim 1, wherein said first and second outputting circuits each include a power save circuit for collecting and reusing of an electric power supplied to said plurality of electrodes, wherein said power save circuit includes:

an electric power collecting capacitor for accumulating a collected electric power; and an electric power collecting coil connecting between said electric power collecting capacitor and said conductive plate, wherein said electric power collecting capacitor and said electric power collecting coil of said first outputting circuit are arranged substantially line-symmetric with said electric power collecting capacitor and said electric power collecting coil of said second outputting circuit, respectively, in respect of a center line of the line-symmetry of said conductive plate.

13. The plasma display apparatus as claimed in claim 1, wherein said plurality of electrodes include:

a plurality of first electrodes; and a plurality of second electrodes arranged substantially parallel to said plurality of first electrodes for generating discharge at a gap formed with said plurality of first electrodes, wherein said drive circuit applies a discharge voltage to either one of said plurality of first electrodes and said plurality of second electrodes.

14. The plasma display apparatus as claimed in claim 13, wherein said first area and said second area of said conductive plate are formed as a single integral metal plate on a first surface of said board.

15. The plasma display apparatus as claimed in claim 1, wherein said plurality of electrodes include:

a plurality of first electrodes; and a plurality of second electrodes arranged substantially parallel to said plurality of first electrodes for generating discharge at a gap formed with said plurality of first electrodes, wherein said drive circuit applies a discharge voltage to either one of said plurality of first electrodes and said plurality of second electrodes, and wherein said first outputting circuit of said drive circuit applies the discharge voltage to odd-number electrodes of said either one of said plurality of first electrodes and said plurality of second electrodes, and said second outputting circuit of said drive circuit applies the discharge voltage to even-number electrodes of said either one of said plurality of first electrodes and said plurality of second electrodes.

16. The plasma display apparatus as claimed in claim 15, wherein said first area of said conductive plate is formed on a first surface of said board, and said second area of said conductive plate is formed on a second surface of said board.

17. A plasma display apparatus, comprising:

a plurality of first electrodes;

a plurality of second electrodes arranged substantially parallel to said plurality of first electrodes;

a first drive circuit which applies a discharge voltage to said plurality of first electrodes; and a second drive circuit which applies a discharge voltage to said plurality of second electrodes, wherein sustain discharge is generated between the first electrodes and the second electrodes, wherein each of said first drive circuit and said second drive circuit includes:

an outputting circuit provided on a board;

a connector provided on the board and coupled to the first electrodes or the second electrodes; and a conductive plate which is provided on the board, and provides an electrical coupling between said outputting circuit and said connector, wherein a difference between a maximum and a minimum of a voltage change between the first electrodes and the second electrodes is equal to or less than 5 volts when sustain discharge currents run between the first electrodes and the second electrodes.

* * * * *